US011378298B2

(12) United States Patent
Park et al.

(10) Patent No.: US 11,378,298 B2
(45) Date of Patent: Jul. 5, 2022

(54) CONTROL METHOD FOR VENTILATION APPARATUS

(71) Applicant: LG ELECTRONICS INC., Seoul (KR)

(72) Inventors: Hansaem Park, Seoul (KR); Janghee Park, Seoul (KR); Yongki Jeong, Seoul (KR); Doyong Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 185 days.

(21) Appl. No.: 16/637,370

(22) PCT Filed: Aug. 6, 2018

(86) PCT No.: PCT/KR2018/008875

§ 371 (c)(1),
(2) Date: Feb. 7, 2020

(87) PCT Pub. No.: WO2019/031780

PCT Pub. Date: Feb. 14, 2019

(65) Prior Publication Data

US 2021/0396421 A1 Dec. 23, 2021

(30) Foreign Application Priority Data

Aug. 7, 2017 (KR) ..... 10-2017-0099761

(51) Int. Cl.
*F24F 11/84* (2018.01)
*F24F 11/74* (2018.01)
(Continued)

(52) U.S. Cl.
CPC ..... *F24F 11/84* (2018.01); *F24F 3/1411* (2013.01); *F24F 11/0008* (2013.01);
(Continued)

(58) Field of Classification Search
CPC ..... F25B 49/04; F24F 3/1429; F24F 2110/12; F24F 2110/22; F24F 11/0008; F24F 3/1411; F24F 11/74; F24F 11/84
See application file for complete search history.

(56) References Cited

U.S. PATENT DOCUMENTS

2007/0144189 A1 6/2007 Ishida et al.
2009/0230202 A1* 9/2009 Matsui ..... F24F 11/0008 236/44 A
(Continued)

FOREIGN PATENT DOCUMENTS

EP 1 752 716 2/2007
EP 2 427 698 3/2012
(Continued)

OTHER PUBLICATIONS

International Search Report dated Dec. 5, 2018 issued in Application No. PCT/KR2018/008875.
(Continued)

*Primary Examiner* — Schyler S Sanks
(74) *Attorney, Agent, or Firm* — Ked & Associates, LLP

(57) ABSTRACT

Disclosed is a control method of a ventilation apparatus, the method including: a determination step in which measured outdoor temperature and humidity and the measured indoor temperature and humidity are equal to or greater than a set temperature and a set humidity; and a drying operation step in which, when the outdoor temperature and humidity and the indoor temperature and humidity, reach the set temperature and the set humidity, a first desiccant heat exchanger and a second heat exchanger operate in a dry mode, wherein the first desiccant heat exchanger is provided in a first common passage, through which indoor space air or outdoor space air flows, to absorb or desorb moisture, and the second desiccant heat exchanger is provided in a second common passage, which is separate from the first common passage, and through which indoor air or outdoor air flows, to absorb or desorb moisture in air.

11 Claims, 4 Drawing Sheets

(51) Int. Cl.

| | |
|---|---|
| ***F24F 3/14*** | (2006.01) |
| ***F24F 11/00*** | (2018.01) |
| ***F24F 110/22*** | (2018.01) |
| ***F24F 110/12*** | (2018.01) |

(52) U.S. Cl.
CPC ..... *F24F 11/74* (2018.01); *F24F 2110/12* (2018.01); *F24F 2110/22* (2018.01)

(56) References Cited

U.S. PATENT DOCUMENTS

| | | | | |
|---|---|---|---|---|
| 2014/0245769 | A1 | 9/2014 | Vandermeulen et al. | |
| 2015/0300665 | A1* | 10/2015 | Sakai | F24F 3/147 261/130 |
| 2016/0146479 | A1* | 5/2016 | Fujita | F24F 3/1411 62/271 |
| 2016/0231007 | A1 | 8/2016 | Ha et al. | |

FOREIGN PATENT DOCUMENTS

| | | |
|---|---|---|
| JP | 11-063561 | 3/1999 |
| JP | 2005-291571 | 10/2005 |
| JP | 2009-109125 | 5/2009 |
| JP | 2013-076476 | 4/2013 |
| KR | 10-2006-0121946 | 11/2006 |
| KR | 10-2016-0097695 | 8/2016 |

OTHER PUBLICATIONS

European Search Report issued in Application No. 18845174.4 dated Mar. 31, 2021.

* cited by examiner

[Fig. 1]
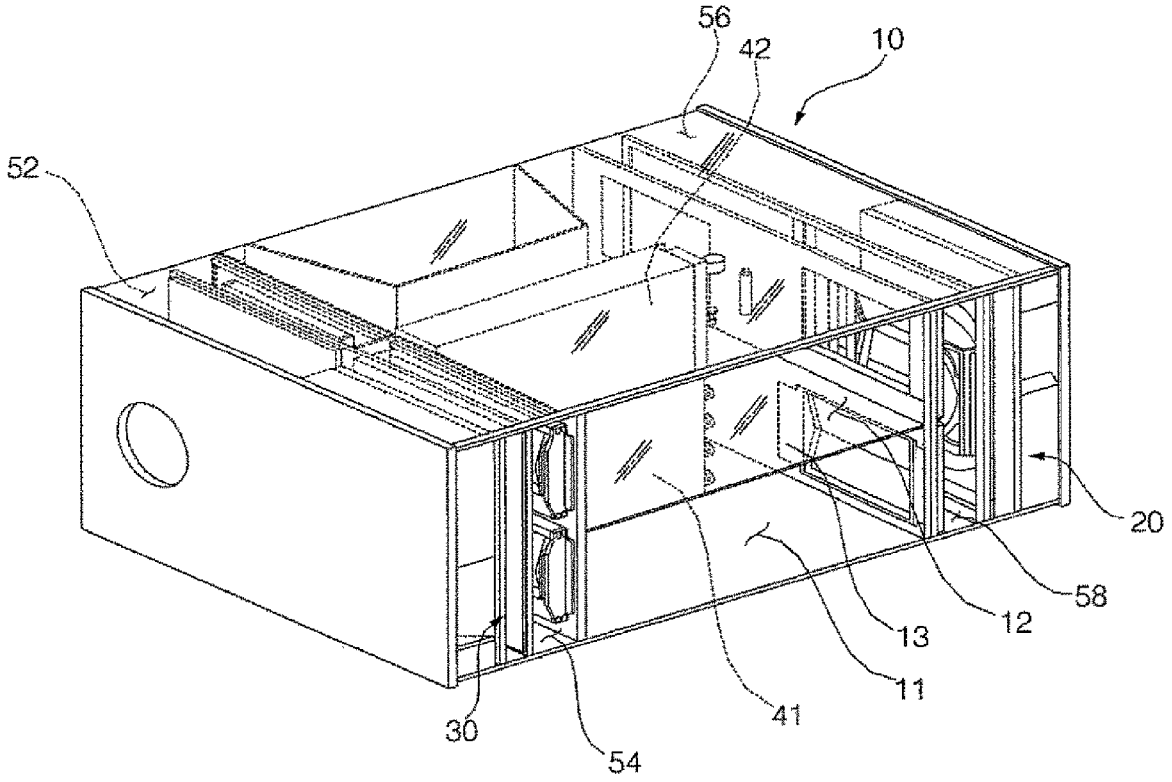

[Fig. 2]
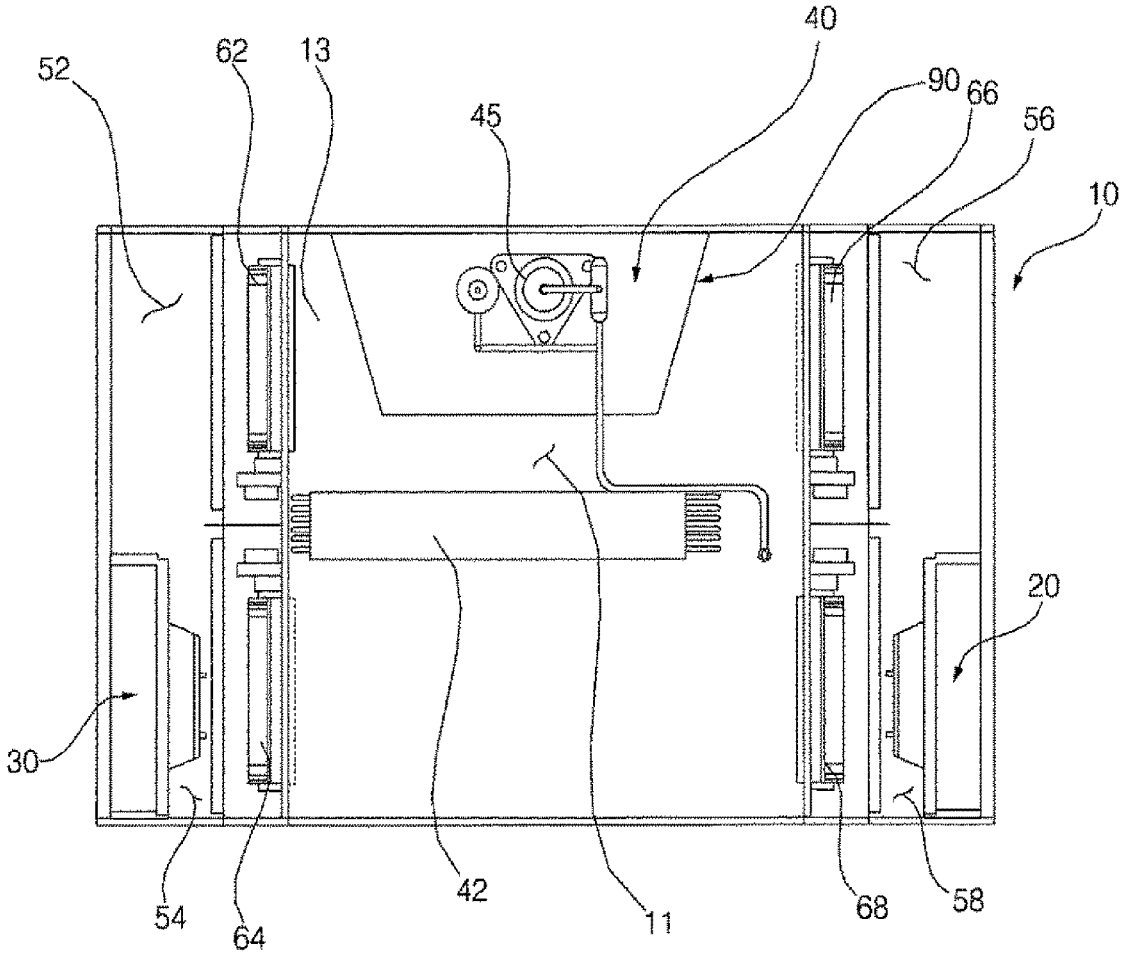

[Fig. 3]
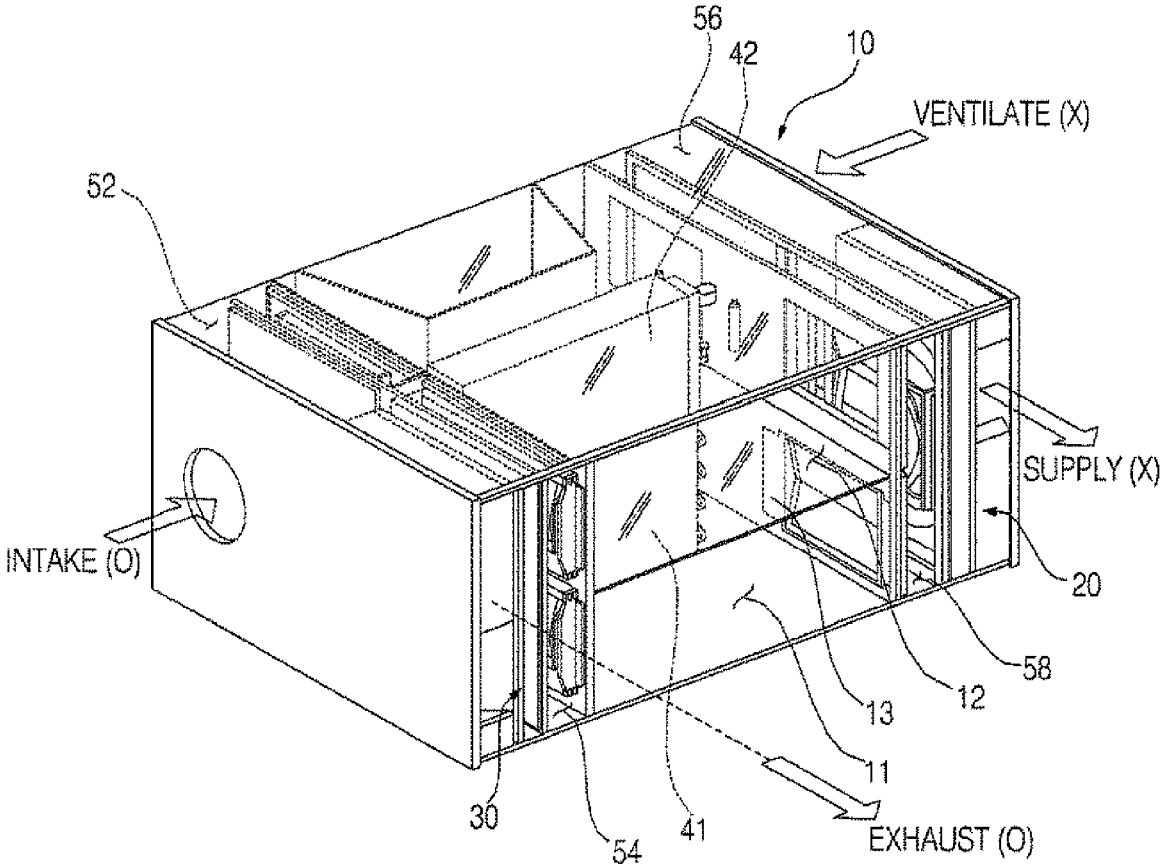

[Fig. 4]
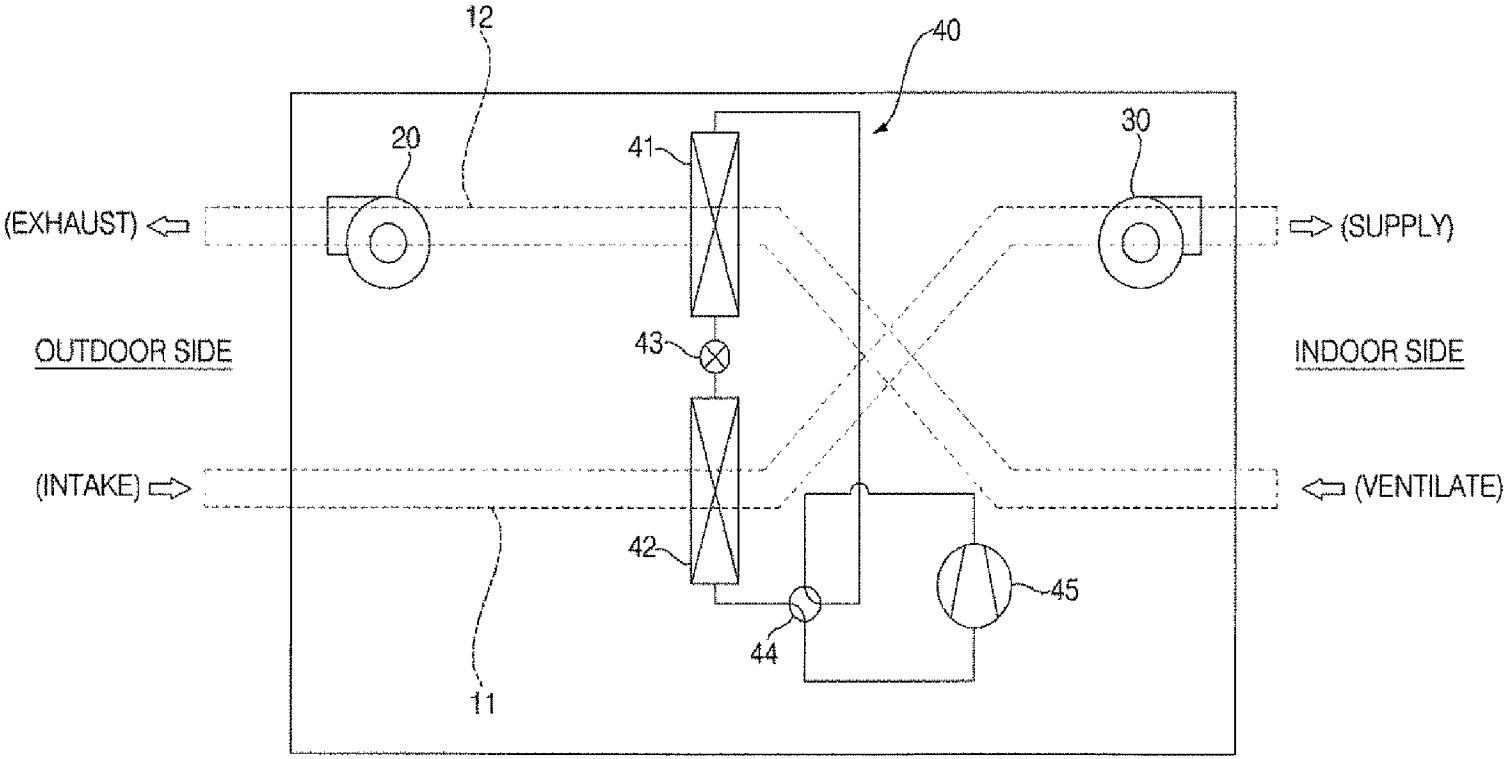

CONTROL METHOD FOR VENTILATION APPARATUS

CROSS-REFERENCE TO RELATED PATENT APPLICATIONS

This application is a U.S. National Stage Application under 35 U.S.C. § 371 of PCT Application No. PCT/KR2018/008875, filed Aug. 6, 2018, which claims priority to Korean Patent Application No. 10-2017-0099761, filed Aug. 7, 2017, whose entire disclosures are hereby incorporated by reference.

TECHNICAL FIELD

The present invention relates to a control method of a ventilation apparatus and, more particularly, to a control method of a ventilation apparatus which is capable of reducing an operation time of a dry mode in which a surface of a desiccant heat exchanger is dried for dehumidification.

BACKGROUND ART

In general, a ventilation apparatus refers to an apparatus which discharges contaminated indoor air while suctioning fresh and clean outdoor air to be supplied to an indoor space.

An air conditioner without a ventilating function cools or heats indoor air while causing the indoor air to circulate.

An air conditioner into which outdoor air is not introduced filters indoor air through a filter or the like, but, if air conditioning is performed only with indoor air, the quality of the indoor air may be slowly deteriorated.

Recently, there are increasing cases in which a ventilation capable of suctioning outdoor air and discharging indoor air is installed in combination with an air conditioner having a cooling function and a heating function.

Meanwhile, a ventilation apparatus according to an existing technology employs a desiccant heat exchanger of which surface is desiccant-coated for indoor dehumidification and humidification.

However, if there is a large amount of moisture absorbed onto the surface of the desiccant heat exchanger used for indoor dehumidification, it dampens dehumidification efficiency so it is necessary to dry the surface of the desiccant heat exchanger frequently.

In addition, an existing technology works such that the surface of the desiccant heat exchanger is naturally dried while operation in a dehumidification mode stops, and, in this case, more time is required to dry the surface of the desiccant heat exchanger and an occupant may not sufficiently feel satisfied with the dehumidification.

DISCLOSURE OF INVENTION

Technical Problem

The present invention has been made in view of the above problems, and it is one object of the present invention to provide a control method of a ventilation apparatus, the method by which a dry mode operation time of a desiccant heat exchanger is remarkably reduced, thereby improving product reliability.

Solution to Problem

In accordance with an embodiment of the present invention, the above and other objects can be accomplished by the provision of a control method of a ventilation apparatus, the method including: a determination step in which outdoor temperature and humidity and indoor temperature and humidity are measured and whether the measured outdoor temperature and humidity and the measured indoor temperature and humidity are equal to or greater than a set temperature and a set humidity; and a drying operation step in which, when the outdoor temperature and humidity and the indoor temperature and humidity, measured in the determination step, reach the set temperature and the set humidity (hereinafter, referred to as a "set condition"), a first desiccant heat exchanger and a second heat exchanger operate in a dry mode, wherein the first desiccant heat exchanger is provided in a first common passage, through which indoor space air (hereinafter, referred to as "indoor air") or outdoor space air (hereinafter, referred to as "outdoor air") flows, to absorb or desorb moisture, and the second desiccant heat exchanger is provided in a second common passage, which is separate from the first common passage, and through which indoor air or outdoor air flows, to absorb or desorb moisture in air, wherein the drying operation step includes: a heat exchanger control step in which a refrigerant is switched from a compressor to be supplied, so that one desiccant heat exchanger needed to be dried (hereinafter, referred to as a "condenser-type desiccant heat exchanger) out of the first desiccant heat exchanger and the second desiccant heat exchanger acts as a condenser while the other desiccant heat exchanger not needed to be dried (hereinafter, referred to as an "evaporator-type desiccant heat exchanger) acts as an evaporator: and a flow rate control step which is performed simultaneously with the heat exchanger control step, and in which a flow rate of air passing through the condenser-type desiccant heat exchanger (hereinafter, referred to as a "first flow rate") is controlled to be less than a flow rate of air passing through the evaporator-type desiccant heat exchanger (hereinafter, referred to as a "second flow rate").

The heat exchanger control step may be a step in which a refrigerant discharged from the compressor is supplied first to the condenser-type desiccant heat exchanger using a refrigerant switching valve.

The heat exchanger control step may be a step in which, when the set condition is satisfied, the first desiccant heat exchanger and the second desiccant heat exchanger are compared in terms of a percentage of moisture absorbed onto a surface (hereinafter, referred to as a "moisture absorption rate") and a refrigerant discharged from the compressor is supplied first to the condense-type desiccant heat exchanger using a refrigerant switching valve.

The heat exchanger control step may be a step in which a desiccant heat exchanger of which the moisture absorption rate is high in the first desiccant heat exchanger and the second desiccant heat exchanger is determined to be the condenser-type desiccant heat exchanger.

The flow rate control step may be a step in which the first flow rate and the second flow rate are controlled by adjusting a rotation amount of a plurality of dampers composed of a plurality of shutter plates which rotates about horizontal axes relative to a plurality of chambers provided to suction indoor air or outdoor air into the first common passage and the second common passage or discharge the indoor air or the outdoor air to the first common passage and the second common passage.

The plurality of dampers may include an indoor suction damper provided in an indoor suction chamber into which indoor air is suctioned toward the first common passage or the second common passage, an indoor discharge damper provided in an indoor discharge chamber through which air is discharged to an indoor space from the first common passage or the second common passage, an outdoor suction damper provided in an outdoor suction chamber into which outdoor air is suctioned toward the first common passage or the second common passage, and an outdoor discharge damper provided in an outdoor discharge chamber through which air is discharged to an outdoor space from the first common passage or the second common passage, and the flow rate control step may be performed such that the indoor suction damper and the indoor discharge damper are controlled to be closed, whereas the outdoor suction damper and the outdoor discharge damper are controlled to be opened.

The flow rate control step may be performed such that, when it is assumed that the condenser-type desiccant heat exchanger is provided in the first common passage and the evaporator-type desiccant heat exchanger is provided in the second common passage, the outdoor suction damper and the outdoor discharge damper in the second common passage are controlled to be fully opened while the outdoor suction damper and the outdoor discharge damper in the first common passage are controlled to be opened to an extent where the first flow rate is less than the second flow rate.

Advantageous Effects of Invention

The advantageous effects of a control method of a ventilation apparatus according to the present invention are as follows.

First, as moisture absorbed onto a surface of a desiccant heat exchanger is dried using a high-temperature and high-pressure refrigerant discharged from a compressor, it is possible to reduce a dry mode operation time considerably.

Second, as a plurality of dampers are adjusted during the dry mode of the desiccant heat exchanger so as to prevent humid air from coming inside an indoor space, it is possible to prevent an occupant from feeling uncomfortable.

Third, as moisture as less as possible is controlled to be absorbed onto a surface of an evaporator-type desiccant heat exchanger, it is possible to improve operation efficiency of the dry mode.

BRIEF DESCRIPTION OF DRAWINGS

FIG. 1 is a perspective view of an example of a ventilation apparatus which implements a control method of a ventilation apparatus according to the present invention.

FIG. 2 is a plan view of FIG. 2.

FIG. 3 is a conceptual airflow diagram of a control method of a ventilation apparatus according to the present invention.

FIG. 4 is a conceptual refrigerant flow diagram of FIG. 3.

BEST MODE FOR CARRYING OUT THE INVENTION

Hereinafter, an embodiment of a ventilation apparatus according to the present invention will be described in detail with reference to the accompanying drawings.

In describing the present invention, well-known functions or constructions will not be described in detail since they may unnecessarily obscure the understanding of the present invention. It should be noted that even if the same terms are used but they indicate different components, they are not given the same reference numerals.

The terms described hereafter are terms defined in consideration of the functions in the present disclosure and may be change in accordance with the intention of a user, such as an experimenter and a measurer, and a custom, so the definition should be based on the entire description of the present disclosure.

Terms used in the specification, 'first', 'second', etc., may be used to describe various components, but the components are not to be construed as being limited to the terms. The terms are used to distinguish one component from another component. For example, the 'first' component may be named the 'second' component, and vice versa, without departing from the scope of the present invention. The term 'and/or' includes a combination of a plurality of items or any one of a plurality of terms.

Terms used in the present specification are used only in order to describe specific exemplary embodiments rather than limiting the present invention. As used herein, the singular forms are intended to include the plural forms as well, unless the context clearly indicates otherwise.

Unless otherwise defined, all terms including technical and scientific terms used herein have the same meaning as commonly understood by one of ordinary skill in the art to which the present invention belongs. It must be understood that the terms defined by the dictionary are identical with the meanings within the context of the related art, and they should not be ideally or excessively formally defined unless the context clearly dictates otherwise.

Further, unless explicitly described otherwise, "comprising" any components will be understood to imply the inclusion of other components rather than the exclusion of any other components.

FIG. 1 is a perspective view illustrating an example of a ventilation apparatus which implements a control method of a ventilation apparatus according to the present disclosure, FIG. 2 is a plan view of FIG. 1, FIG. 3 is a conceptual airflow diagram of a control method of a ventilation apparatus according to the present disclosure, and FIG. 4 is a conceptual refrigerant flow diagram of FIG. 3.

An example of a ventilation apparatus which implements a control method of a ventilation apparatus according to the present disclosure will be described prior to the control method.

Referring to FIGS. 1 and 2, an example of a ventilation apparatus according to the present disclosure includes a case 10, an outdoor discharge fan 20 which is installed in the case 10 and discharges air to an outdoor space, an indoor discharge fan 30 which is installed in the case 10 and discharges air to an indoor space, and an air conditioning unit 40 which is installed in the case 10 and perform air conditioning on an airflow.

The case 10 includes a first common passage 11 through which indoor space air (hereinafter, referred to as indoor air) or outdoor space air (hereinafter, referred to as outdoor air) flows, a second common passage 12 which is positioned above the first common passage 11, an indoor suction chamber 52 which is connected to the first common passage 11 and the second common passage 12 and into which indoor air is suctioned, an indoor discharge chamber 54 which is connected to the first common passage 11 and the second common passage 12 and from which air is discharged into an indoor space, an outdoor suction chamber 56 which is connected to the first common passage 11 and the second common passage 12 and into which outdoor air is suctioned, and an outdoor discharge chamber 58 which is connected to the first common passage 11 and the second common passage 12 and from which air is discharged to an outdoor space.

Hereinafter, for convenience of explanation, introducing indoor air through the indoor suction chamber 52 is referred to as "ventilating", discharging air into an indoor space through the indoor discharge chamber 54 is referred to as "supplying", introducing outdoor air through the outdoor suction chamber 56 is referred to as "intaking", and discharging air to an outdoor space through the outdoor discharge chamber 58 is referred to as "exhausting".

The first common passage 11 and the second common passage 12 are formed by an upper and lower side separation plate 13. The first common passage 11 may be formed under the upper and lower side separation plate 13, and the second common passage 12 may be formed above the upper and lower side separation 13.

A suction guide 90 may be provided in each of the first common passage 11 and the second common passage 12. The suction guide 90 guides ventilated air or intake air, which is suctioned through the indoor suction chamber 52 and the outdoor suction chamber 56, to desiccant heat exchangers 41 and 42 of the air conditioning unit 40.

In addition, an indoor suction damper 62, an indoor discharge damper 64, an outdoor suction damper 66, and an outdoor discharge damper 68 are respectively disposed in the indoor suction chamber 52, the indoor discharge chamber 54, the outdoor suction chamber 56, and the outdoor discharge chamber 58 so as to control an air flow with the first common passage 11 or the second common passage 12.

Thus, the above described plurality of dampers 62 to 68 may be respectively provided in four chambers of the first common passage 11 and respectively provided in four chambers of the second common passage 12, and thus, it is desirable that eight chambers in total are provided Meanwhile, as illustrated in FIG. 4, the air conditioning unit 40 includes a compressor 45, desiccant heat exchangers 41 and 42 respectively provided in the first common passage 11 and the second common passage 12, an expansion valve 43, and a refrigerant switching valve 44.

In this case, for convenience of explanation, out of the desiccant heat exchangers 41 and 42, a desiccant heat exchanger provided in the first common passage 11 will be referred to as a "first desiccant heat exchanger 41", and a desiccant heat exchanger provided in the second common passage 12 will be referred to as a "second desiccant heat exchanger".

That is, the first desiccant heat exchanger 41 may be disposed inside the first common passage 11 positioned under the upper and lower side separation plate 13, and the second desiccant heat exchanger 42 may be disposed inside the second common passage 12 positioned above the upper and lower side separation plate 13.

In this case, the air conditioning unit 40 may be a heat pump capable of operating in a cooling cycle and a heating cycle. Thus, when the first desiccant heat exchanger 41 acts as a condenser due to switching of a flow by the refrigerant switching valve 44, the second desiccant heat exchanger 42 acts as an evaporator, and, when the first desiccant heat exchanger 41 acts as an evaporator, the second desiccant heat exchanger 42 acts as a condenser. The operating mechanism of the air conditioner 40 is a general technology well known for a person skilled in the art, and thus, a detailed description thereof will be omitted.

In particular, the first desiccant heat exchanger 41 and the second desiccant heat exchanger 42 may be arranged to partition the first common passage 11 and the second common passage 12 into a suction side passage, in which the indoor suction chamber 52 and the outdoor suction chamber 56 are provided, and a discharge side passage in which the indoor discharge chamber 54 and the outdoor discharge chamber 58.

Meanwhile, surfaces of the desiccant heat exchangers 41 and 42 are desiccant coated to absorb moisture in the air. The desiccant coating is made of a material capable of absorbing moisture in the air and dissipating the absorbed moisture into the air upon application of heat, and such a material is generally used by a person skilled in the art and thus detailed description thereof will be omitted.

An example of the ventilation apparatus configured as above has a refrigerant flow as illustrated in FIG. 4.

That is, high-temperature and high-pressure refrigerant discharged from the compressor 45 may be switched by the refrigerant switching valve 44 and then flow into the first desiccant heat exchanger 41 provided in the first common passage 11 or may flow into the second desiccant heat exchanger 42 provided in the second common passage 12.

While passing through the first desiccant heat exchanger 41, the refrigerant flown into the first desiccant heat exchanger 41 let the first desiccant heat exchanger 41 act as a condenser (for this reason, hereinafter referred to as a "condenser-type desiccant heat exchanger", when needed), and the refrigerant supplies moisture absorbed onto the surface of the first desiccant heat exchanger 41 to the air passing through the first desiccant heat exchanger 41, by which the moisture is desorbed.

The refrigerant condensed while passing through the first desiccant heat exchanger 41 is expanded while passing through the expansion valve 43, and then flows into the second desiccant heat exchanger 42 provided in the second common passage 12.

While passing through the second desiccant heat exchanger 42, the refrigerant flown to the side of the second desiccant heat exchanger 42 lets the second desiccant heat exchanger 42 to act as an evaporator 42 (for this reason, hereinafter referred to as an "evaporator-type desiccant heat exchanger"), and the refrigerant causes moisture in the air passing through the second desiccant heat exchanger 42 to be absorbed on the surface of the second desiccant heat exchanger 42.

The refrigerant passing through the second desiccant heat exchanger 42 may be recovered to the compressor 45 by passing through a not-illustrated accumulator.

The following is description about a ventilation mode, a dehumidification mode, and a humidification mode using an example of a ventilation apparatus with reference to FIGS. 3 and 4.

First, in the dehumidification mode, when a dehumidification command signal is received, the above-described dampers 62 to 68 provided in the first common passage 11 are adjusted so as to exhaust humid indoor air to an outdoor space, and the above-described dampers 62 to 68 provided in the second common passage 12 are adjusted so as to supply outdoor air to an indoor space through the second common passage 12, wherein moisture in the outdoor air is absorbed onto the surface of the second desiccant heat exchanger 42 which acts as an evaporator so that dry air is supplied to the indoor space.

More specifically, the above-described dampers 62 to 68 provided in the first common passage 11 are controlled such that the indoor suction damper 62 and the outdoor discharge damper 68 are opened and the indoor discharge damper 64 and the outdoor suction damper 66 are closed, and the above-described dampers 62 to 68 provided in the second common passage 12 are controlled such that the outdoor suction damper 66 and the indoor discharge damper 64 are opened and the outdoor discharge damper 68 and the indoor suction damper 62 are closed.

Next, in the humidification mode, when a humidification command signal is received, the above-described dampers 62 to 68 provided in the first common passage 11 are adjusted so as to supply outdoor air to an indoor space through the first common passage 11, wherein moisture is supplied to the outdoor air passing through the first desiccant heat exchanger 41, acting as a condenser, so that humid air is supplied to the indoor space, and the above-described dampers 62 to 68 provided in the second common passage 12 are adjusted so that relatively dry indoor air is exhausted to an outdoor space through the second common passage 12.

More specifically, the above-described dampers 62 to 68 provided in the first common passage 11 are controlled such that the outdoor suction damper 66 and the indoor discharge damper 64 are opened and the outdoor discharge damper 68 and the indoor suction damper 62 are closed, and the above-described dampers 62 to 68 provided in the second common passage 12 are controlled such that the indoor suction damper 62 and the outdoor discharge damper 68 are opened and the indoor discharge damper 64 and the outdoor suction damper 66 are closed.

In the dehumidification mode, in the case of exhausting indoor air to an outdoor space, when a flow of refrigerant is switched by the refrigerant switching valve 44, the first desiccant heat exchanger 41 in the first common passage 11, while acting as a condenser, desorbs moisture absorbed onto the surface of the first desiccant heat exchanger 41 and exhausts the desorbed moisture for the sake of later indoor dehumidification.

In contrast, in the humidification mode, in the case of exhausting indoor air to an outside space, when a flow of refrigerant is switched by the refrigerant switching valve 44, the second desiccant heat exchanger 42 in the second common passage 12, while acting as an evaporator, absorbs a sufficient amount of moisture from indoor air, exhausted from the second desiccant heat exchanger 42, for the sake of indoor humidification.

Meanwhile, the ventilation mode may be implemented in a manner in which, while the compressor 45 is power off, the dampers 62 to 68 in the first common passage 11 and the dampers 62 to 68 in the second common passage 12 are controlled properly, so that outdoor air is supplied to an indoor space through one of the first common passage 11 and the second common passage 12 and, at the same time, indoor air is exhausted to an outdoor space through the other thereof.

The ventilation apparatus according to the above-described embodiment provides an occupant with a continuous dehumidified or humidified environment by properly controlling the above-described dampers 62 to 68 while alternatively using the two heat exchangers 41 and 42 by switching the refrigerant switching valve 44 according to a percentage of moisture absorbed onto the surfaces of the first desiccant heat exchangers 41 and the second desiccant heat exchanger 42.

For example, in the dehumidification mode for dehumidifying an indoor space, when the first desiccant heat exchanger 41 in the first common passage 11 is set as an evaporator-type desiccant heat exchanger, moisture is absorbed using the first desiccant heat exchanger 41 and moisture is desorbed using the second desiccant heat exchanger 42 in the second common passage 12.

In this case, before a percentage of absorption of moisture of the first desiccant heat exchanger reaches a saturated state, the refrigerant switching valve 44 is switched so that the second desiccant heat exchanger 42 in the second common passage 12 acts as an evaporator-type desiccant heat exchanger whereas at the same time the first desiccant heat exchanger 41 in the first common passage 11 acts as a condenser-type desiccant heat exchanger. In addition, the dampers 62 to 68 in the first common passage 11 are adjusted to exhaust indoor air to an outside space whereas at the same time the dampers 62 to 68 in the second common passage 12 are adjusted to supply outdoor air to an indoor space, so that moisture of the outdoor air is absorbed onto the surface of the second desiccant heat exchanger 42 and hence dry air is supplied to the indoor space.

In this case, in the dehumidification mode, for example, when a percentage of moisture absorbed onto the surface of the first desiccant heat exchanger 41 acting as an evaporator-type desiccant heat exchanger reaches a saturated state, an existing method is implemented in a manner of stopping operation of the compressor 45 and then operating the ventilation apparatus only in the above-described ventilation mode to thereby execute a dry mode.

However, when the outdoor space is hot and humid and the indoor space is cold and humid, a percentage of moisture absorbed onto the evaporator-type desiccant heat exchanger is high but a percentage of moisture desorbed therefrom is low, and therefore, a dry mode operation time increases significantly. If the evaporator-type desiccant heat exchanger is not dried well, the dehumidification mode is executed while there is a great amount of absorbed moisture, and thus, dehumidification performance is naturally deteriorated.

A control method of a ventilation apparatus according to the present invention proposes the following embodiment to solve the above-described existing problem.

That is, as illustrated in FIGS. 3 and 4, a control method of a ventilation apparatus according the present disclosure includes: a determination step in which indoor temperature and humidity and outdoor temperature and humidity are measured and whether the measured indoor temperature and humidity and the measured outdoor temperature and humidity are equal to or greater than a set temperature and a set humidity is determined; and a drying operation step in which, when it is determined in the determination step that the measured indoor temperature and humidity and the measured outdoor temperature and humidity reach a set humidity condition (hereinafter, referred to as a "set condition"), the first desiccant heat exchanger 41 provided in the first common passage 11, through which indoor air and outdoor air flows, to absorb or desorb moisture in the air operates in a dry mode, and a second desiccant heat exchanger 42 provided in the second common passage 12 to absorb or desorb moisture in the air operates in the dry mode.

In this case, the drying operation step includes: a heat exchanger control step in which refrigerant is switched from the compressor to be supplied, so that one desiccant heat exchanger needed to be dried (a condenser-type desiccant heat exchanger) out of the first desiccant heat exchanger 41 and the second desiccant heat exchanger 42 acts as a condenser while the other desiccant heat exchanger not needed to be dried (an evaporator-type desiccant heat exchanger) acts as an evaporator; and a flow rate control step which is performed simultaneously with the heat exchanger control step, and in which a flow rate of air passing through the condenser-type desiccant heat exchanger (the flow rate is hereinafter referred to as a "first flow rate") is controlled to be less than a flow rate of air passing through the evaporator-type desiccant heat exchanger (the flow rate is hereinafter referred to as a "second flow rate").

The heat exchanger control step may be defined as a step in which refrigerant discharged from the compressor 45 is supplied first to the condenser-type desiccant heat exchanger using the refrigerant switching valve 44.

The first desiccant heat exchanger 41 and the second desiccant heat exchanger 42 are replaced by the term "condenser-type desiccant heat exchanger" or "evaporator-type desiccant heat exchanger", but indoor dehumidification or humidification is not actually performed, and thus, it is desirable to define the first desiccant heat exchanger 41 and the second desiccant heat exchanger 42 by classifying the same according to a flow of refrigerant.

Meanwhile, the heat exchanger control step may be defined as a step in which, when the above-described set condition is satisfied, the first desiccant heat exchanger 41 and the second desiccant heat exchanger 42 are compared in terms of a percentage of moisture absorbed onto a surface (hereinafter, referred to as a "moisture absorption rate") and then refrigerant discharged from the compressor 45 is supplied first to the condenser-type desiccant heat exchanger using the refrigerant switching valve 44.

In addition, the heat exchanger control step may be a step in which a desiccant heat exchanger 41 or 42 having a high moisture absorption rate out of the first desiccant heat exchanger 41 and the second desiccant heat exchanger 42 is determined to be the condenser-type desiccant heat exchanger.

Meanwhile, the flow rate control step is a step in which the first flow rate and the second air flow rate are controlled by adjusting a rotation amount of a plurality of dampers 62 to 68 composed of a plurality of shutter plates (not indicated by reference numerals) which rotates horizontal axes relative to the plurality of chambers 52 to 58 provided to suction indoor air or outdoor air into the first common passage 11 and the second common passage 12 or discharge the indoor air or outdoor air to the first common passage 11 and the second common passage 12.

More specifically, the flow rate control step may be a step in which, out of the plurality of dampers 62 to 68, the indoor suction damper 62 and the indoor discharge damper 64 are closed and the outdoor suction damper 66 and the outdoor discharge damper 68 are opened.

Unlike in the general ventilation, dehumidification, and humidification modes, the preferred embodiment of the control method of a ventilation apparatus according to the present invention focuses on a drying operation which is performed such that outdoor air is suctioned into an inner space through the outdoor suction damper 66 in the first common passage 11 and the outdoor suction damper 66 in the second common passage 12, at the same time, and, while passing through the first desiccant heat exchanger 41 and the second desiccant heat exchanger 42 respectively provided in the first common passage 11 and the second common passage 12, the suctioned outdoor air dries the first common passage 11 and the second common passage 12.

However, since the second desiccant heat exchanger 42 acting as an evaporator-type desiccant heat exchanger absorbs moisture, the same may not be dried properly, and, for this reason, in the preferred embodiment of the control method of a ventilation apparatus according to the present invention, temperature in the entire system including the first common passage 11 and the second common passage 12 is controlled to increase so that the evaporator-type desiccant heat exchanger is dried easily.

That is, in the preferred embodiment of the control method of a ventilation apparatus according to the present invention, for example, when it is assumed that the condenser-type desiccant heat exchanger is provided in the first common passage 11 and the evaporator-type desiccant heat exchanger is provided in the second common passage 12, the outdoor suction damper 66 and the outdoor discharge damper 68 in the second common passage 12 are controlled to be fully opened while the outdoor suction damper 66 and the outdoor discharge damper 68 in the first common passage 11 are controlled to be opened to an extent where the first flow rate is less than the second flow rate.

As above, the first flow rate of air suctioned into the first common passage 11, in which the condenser-type desiccant heat exchanger, and the second flow rate of air suctioned into the second common passage 12, in which the evaporator-type desiccant heat exchanger, are controlled by properly adjusting a degree of opening of the above-described dampers 62 to 68, and, by doing so, temperature of the entire system increases, which makes moisture quickly desorbed from the evaporator-type desiccant heat exchanger and the condenser-type desiccant heat exchanger at the same time.

As such, if the dry mode operation time is reduced, it is possible to minimize a disruption time of an indoor dehumidification mode, thereby greatly improving dehumidifying performance.

As above, the preferred embodiment of the control method of a ventilation apparatus according to the present invention has been described in detail with reference to the accompanying drawings. However, embodiments of the present invention is not necessarily limited to the above-described embodiment, and it is apparent to one of ordinary skill in the art that various changes may be made thereto without departing from the claims and equivalents thereof. Thus, the scope of the present invention should be defined by the appended claims.

The invention claimed is:

1. A control method of a ventilation apparatus, the ventilation apparatus comprising a case includes a first common passage through which indoor air or outdoor air flows, a second common passage which is positioned above the first common passage, an indoor suction chamber which is connected to the first common passage and the second common passage and into which indoor air is suctioned, an indoor discharge chamber which is connected to the first common passage and the second common passage and from which air is discharged into an indoor space, an outdoor suction chamber which is connected to the first common passage and the second common passage and into which outdoor air is suctioned, and an outdoor discharge chamber which is connected to the first common passage and the second common passage and from which air is discharged to an outdoor space; a first desiccant heat exchanger provided in the first common passage, through which indoor air or outdoor air flows, to absorb or desorb moisture in air; a second desiccant heat exchanger provided in the second common passage, which is separate from the first common passage, and through which indoor air or outdoor air flows, to absorb or desorb moisture in air; an indoor suction damper provided in die indoor suction chamber into which indoor air is suctioned toward the first common passage or the second common passage; an indoor discharge damper provided in the indoor discharge chamber through which air is discharged to the indoor space from the first common passage or the second common passage; an outdoor suction damper provided in the outdoor suction chamber into which outdoor air is suctioned toward the first common passage or the second common passage; and an outdoor discharge damper provided in the outdoor discharge chamber through which air is discharged to the outdoor space from the first common passage or the second common passage, the method comprising measuring outdoor temperature and humidity and indoor temperature and humidity; and operating the first desiccant heat exchanger and the second heat exchanger in a dry mode, when the measured outdoor temperature and humidity and the measured indoor temperature and humidity are equal to or greater than a set temperature and a set humidity, wherein the dry mode comprises:

a heat exchanger control operation in which refrigerant output from a compressor is switched, so that one of the first desiccant heat exchanger or the second desiccant heat exchanger which needs to be dried acts as a condenser while the other of the first desiccant heat exchanger or the second desiccant heat exchanger which does not need to be dried acts as an evaporator, and a flow rate control operation which is performed simultaneously with the heat exchanger control operation, and in which a first flow rate of air passing through the one of the first desiccant heat exchanger or the second desiccant heat exchanged is controlled to be less than a second flow rate of air passing through the other of the first desiccant heat exchanger or the second desiccant heat exchanged, wherein, in the flow rate control operation, the first flow rate and the second flow rate are controlled by adjusting each of the indoor suction damper, the indoor discharge damper, the outdoor suction damper, and the outdoor discharge damper, and wherein the flow rate control operation is performed such that the indoor suction damper and the indoor discharge damper are controlled to be closed, whereas the outdoor suction damper and the outdoor discharge damper are controlled to be opened.

2. The control method of claim 1, wherein, in the heat exchanger control operation, refrigerant discharged from the compressor is supplied first to the one of the first desiccant heat exchanger or the second desiccant heat exchanger using a refrigerant switching valve.

3. The control method of claim 1, wherein, in the heat exchanger control operation, when the measured outdoor temperature and humidity and the measured indoor temperature and humidity are equal to or greater than the set temperature and the set humidity, the first desiccant heat exchanger and the second desiccant heat exchanger are compared in terms of a percentage of moisture absorbed onto a surface and refrigerant discharged from the compressor is supplied first to the one of the first desiccant heat exchanger or the second desiccant heat exchanger using a refrigerant switching valve.

4. The control method of claim 3, wherein, in the heat exchanger operation, a desiccant heat exchanger of the first desiccant heat exchanger and the second desiccant heat exchanger a moisture absorption rate of which is high is determined to be the one of the first desiccant heat exchanger or the second desiccant heat exchanger.

5. The control method of claim 1, wherein each of the indoor suction damper, the indoor discharge damper, the outdoor suction damper, and the outdoor discharge damper includes a plurality of shutter plates that rotates about horizontal axes, wherein, in the flow rate control operation, the first flow rate and the second flow rate are controlled by adjusting a rotational amount of each of the indoor suction damper, the indoor discharge damper, the outdoor suction damper, and the outdoor discharge damper.

6. The control method of claim 1, wherein in the flow rate control operation, when it is assumed that the one of the first desiccant heat exchanger or the second desiccant heat exchanger is provided in the first common passage and the other of the first desiccant heat exchanger or the second desiccant heat exchanger is provided in the second common passage, the outdoor suction damper and the outdoor discharge damper in the second common passage are controlled to be fully opened while the outdoor suction damper and the outdoor discharge damper in the first common passage are controlled to be opened to an extent to which the first flow rate is less than the second flow rate.

7. A control method of a ventilation apparatus, the ventilation apparatus comprising a case includes a first common passage through which indoor air or outdoor air flows, a second common passage which is positioned above the first common passage, an indoor suction chamber which is connected to the first common passage and the second common passage and into which indoor air is suctioned, an indoor discharge chamber which is connected to the first common passage and the second common passage and from which air is discharged into an indoor space, an outdoor suction chamber which is connected to the first common passage and the second common passage and into which outdoor air is suctioned, and an outdoor discharge chamber which is connected to the first common passage and the second common passage and from which air is discharged to an outdoor space; a first desiccant heat exchanger provided in the first common passage, through which indoor air or outdoor air flows, to absorb or desorb moisture in air; a second desiccant heat exchanger provided in the second common passage, which is separate from the first common passage, and through which indoor air or outdoor air flows, to absorb or desorb moisture in air; an indoor suction damper provided in the indoor suction chamber into which indoor air is suctioned toward the first common passage or the second common passage; an indoor discharge damper provided in the indoor discharge chamber through which air is discharged to the indoor space from the first common passage or the second common passage; an outdoor suction damper provided in the outdoor suction chamber into which outdoor air is suctioned toward the first common passage or the second common passage; and an outdoor discharge damper provided in the outdoor discharge chamber through which air is discharged to the outdoor space from the first common passage or the second common passage, the method comprising:

measuring outdoor temperature and humidity and indoor temperature and humidity; and operating the first desiccant heat exchanger and the second heat exchanger in a dry mode, when the measured outdoor temperature and humidity and the measured indoor temperature and humidity are equal to or greater than a set temperature and a set humidity, wherein the dry mode comprises:

a heat exchanger control operation in which refrigerant output from a compressor is switched, so that one of the first desiccant heat exchanger or the second desiccant heat exchanger which needs to be dried acts as a condenser while the other of the first desiccant heat exchanger or the second desiccant heat exchanger which does not need to be dried acts as an evaporator, and a flow rate control operation which is performed simultaneously with the heat exchanger control operation, and in which a first flow rate of air passing through the one of the first desiccant heat exchanger or the second desiccant heat exchanger is controlled to be less than a second flow rate of air passing through the other of the first desiccant heat exchanger or the second desiccant heat exchanger, wherein, in the heat exchanger operation, a desiccant heat exchanger of the first desiccant heat exchanger and the second desiccant heat exchanger a moisture absorption rate of which is high is determined to be the one of the first desiccant heat exchanger or the second desiccant heat exchanger.

8. The control method of claim 7, wherein, in the heat exchanger control operation, refrigerant discharged from the compressor is supplied first to the one of the first desiccant heat exchanger or the second desiccant heat exchanger using a refrigerant switching valve.

9. The control method of claim 7, wherein, in the heat exchanger control operation, when the measured outdoor temperature and humidity and the measured indoor temperature and humidity are equal to or greater than the set temperature and the set humidity, the first desiccant heat exchanger and the second desiccant heat exchanger are compared in terms of a percentage of moisture absorbed onto a surface and refrigerant discharged from the compressor is supplied first to the one of the first desiccant heat exchanger or the second desiccant heat exchanger using a refrigerant switching valve.

10. The control method of claim 7, wherein each of the indoor suction damper, the indoor discharge damper, the outdoor suction damper, and the outdoor discharge damper includes a plurality of shutter plates that rotates about horizontal axes, wherein, in the flow rate control operation, the first flow rate and the second flow rate are controlled by adjusting a rotational amount of each of the indoor suction damper, the indoor discharge damper, the outdoor suction damper, and the outdoor discharge damper.

11. The control method of claim 7, wherein, in the flow rate control operation, when it is assumed that the one of the first desiccant heat exchanger or the second desiccant heat exchanger is provided in the first common passage and the other of the first desiccant heat exchanger or the second desiccant heat exchanger is provided in the second common passage, the outdoor suction damper and the outdoor discharge damper in the second common passage are controlled to be fully opened while the outdoor suction damper and the outdoor discharge damper in the first common passage are controlled to be opened to an extent to which the first flow rate is less than the second flow rate.

* * * * *